US006765221B2

(12) United States Patent
Elder et al.

(10) Patent No.: US 6,765,221 B2
(45) Date of Patent: Jul. 20, 2004

(54) METHOD AND APPARATUS FOR SHIPPING SUBSTANTIALLY PURE URANIUM HEXAFLUORIDE

(75) Inventors: Gary Elder, Orlando, FL (US); Thomas F. Dougherty, Chagrin Falls, OH (US); Trevor M. Rummel, Leetonia, OH (US)

(73) Assignee: Westinghouse Electric Company, LLC, Pittsburg, PA (US)

( * ) Notice: Subject to any disclaimer, the term of this patent is extended or adjusted under 35 U.S.C. 154(b) by 0 days.

(21) Appl. No.: 10/358,945

(22) Filed: Feb. 5, 2003

(65) Prior Publication Data

US 2003/0173528 A1 Sep. 18, 2003

Related U.S. Application Data

(63) Continuation-in-part of application No. 09/840,314, filed on Apr. 23, 2001, now Pat. No. 6,534,776.

(51) Int. Cl.[7] ..... G21F 5/12
(52) U.S. Cl. ..... 250/506.1; 250/507.1
(58) Field of Search ..... 250/506.1, 507.1; 277/320; 73/46, 49.3

(56) References Cited

U.S. PATENT DOCUMENTS 6,534,776 B2 * 3/2003 Dougherty et al. ..... 250/506.1

FOREIGN PATENT DOCUMENTS

GB 2265675 A * 10/1993 ..... F16J/15/10

* cited by examiner

*Primary Examiner*—Jack Berman
(74) *Attorney, Agent, or Firm*—Renner, Otto, Boisselle & Sklar, LLP

(57) ABSTRACT

Substantially pure uranium hexafluoride is shipped in a conventional overpack. A cylinder includes a vessel with a cylindrical sidewall A head permanently affixed to the sidewall closes one end of the vessel. A valve controls the flow of matter into and out of the vessel. A sealing surface connected to the vessel surrounds the valve. A cap covers the valve and a pair of seals is located between the sealing surface and the cap. The volume between the two seals, the cap and the sealing surface defines a test volume. A test port connects the test volume and an exterior surface of the vessel, and fasteners press the cap against the sealing surface. A maximum rate of leakage from within the cap to the atmosphere outside the cap is determined by measuring the leakage rate into the test volume with a leak testing apparatus connected to the test port. Thereafter the cylinder is placed in a conventional overpack. The maximum leakage rate is determined using a test apparatus consisting essentially of a vacuum pump, a pressure gauge, a container of known volume, a valve to control the flow of air from the atmosphere into the container which are all adapted to be connected to the test port at the same time, a valve controlling the flow of gas from the container into the test volume, and a valve controlling the flow of gas from the test volume to the vacuum pump.

13 Claims, 5 Drawing Sheets

METHOD AND APPARATUS FOR SHIPPING SUBSTANTIALLY PURE URANIUM HEXAFLUORIDE

RELATED APPLICATIONS

This application is a continuation in part of U.S. Ser. No. 09/840,314, filed Apr. 23, 2001, now U.S. Pat. No. 6,534,776 and titled VESSEL FOR URANIUM HEXAFLUORIDE TRANSPORT.

BACKGROUND OF THE INVENTION

The present invention relates to a vessel for the transportation and storage of substantially pure uranium hexafluoride, to improvements in a vessel for transporting substantially pure uranium hexafluoride, for example a vessel known in the trade as a 30B cylinder, and to a method and apparatus for using such an improved cylinder.

Enriched uranium hexafluoride has been shipped in conventional 30B cylinders for many years. Uranium hexafluoride is considered enriched if it includes more than 1% Uranium 235 ($U_{235}$), and shipments of enriched uranium hexafluoride (up to 5%) must be made in conventional, approved 30B cylinders. If the cylinders are full, they must be shipped in an approved overpack for impact and thermal protection. Such shipments are considered safe if the cylinders are properly packaged and transported. So long as water or other possible moderators of neutrons are kept separate from the uranium hexafluoride itself, a critical event (an uncontrolled nuclear chain reaction) cannot occur.

As with all aspects of the nuclear industry within the geographic limits of its authority, the Nuclear Regulatory Commission (NRC) regulates the transport of uranium hexafluoride. Because its authority extends to United States ports and because its regulations are among the most conservative in the world, the NRC's regulations establish minimum standards for most international shipping of uranium hexafluoride. American National Standards Institute, Inc. published ANSI N14.1, Packaging of Uranium Hexafluoride for Transport, in 1971. This standard was adopted by the NRC's predecessor and established the approved design of the conventional 30B cylinder. Uranium Hexafluoride for Transport, in 1971. This standard was adopted by the NRC's predecessor and established the approved design of the conventional 30B cylinder.

The conventional 30B cylinder, currently defined by ANSI N14.1-1995, is a steel vessel about 81½ inches long and 30 inches in diameter. It is made from half-inch carbon steel formed into a cylindrical body 54 inches long capped by two roughly semi-ellipsoidal heads. A pair of chimes protects the ends of the vessel. The conventional 30B cylinder has a tare weight of about 1425 lbs. and a volume of about 26 cubic feet. When filled to its maximum permitted capacity of 5020 lbs. with uranium hexafluoride having up to approximately five percent by weight uranium 235 isotope, as little as 15 liters of water could conceivably initiate a critical event. It is therefore vitally important that water be excluded from the cylinder.

There are other risks associated with the shipment of uranium hexafluoride. If this chemical is heated to its triple point of 146° F. in the presence of air, gaseous hydrogen fluoride ($HF_{(g)}$) can be formed. Such an event is conceivable if the valve on a conventional 30B cylinder breaks during a fire event. Hydrogen fluoride gas is extremely harmful, and its release must be guarded against since death follows almost immediately if it is inhaled.

Two openings are formed in the conventional 30B cylinder. The openings are located at approximately diagonally opposite locations on opposite heads. One opening accommodates a valve which is used routinely for filling and emptying the tank of uranium hexafluoride. The other opening is a plug used for periodic inspection, hydrostatic testing, and cleaning of the tank. This valve and this plug form the only barriers to water entry into the conventional 30B cylinder.

During shipment a 30B cylinder is housed in a protective shipping package or "overpack." The overpack protects the cylinder within from accidental impacts and insulates the cylinder to reduce the chance that it will leak if there is a fire or other accidental overheating event. The overpack and 30B cylinder are routinely shipped by ocean-going vessels as well as by rail and road transport. When the cylinder arrives at a processing plant, it is removed from the overpack and standardized piping is connected to the valve. The 30B is then heated in an autoclave to evaporate and so remove the uranium hexafluoride.

Overpacks are regulated by governmental agencies. The U.S. Department of Transportation (DOT) has issued a standard specification, DOT 21 PF1, which defines an overpack. That regulation is published at 49 CFR 178.358. The Department of Transportation allows certain variations of this design in Certificate USA/4909/AF, Revision 15. Overpacks made to this specification or its permitted variations are termed "specification packages". In addition, the NRC has issued regulations which define so-called "performance packages". These packages are approved by the NRC if they meet the performance standards set forth in the regulations. The performance specifications are published at 49 CFR 173.401-476. One common feature of both the DOT and the NRC regulations is that the overpack must be designed to fit a conventional 30B cylinder as defined by ANSI N14.1

Regulations require periodic testing of 30B cylinders. Specifically, the DOT has adopted ANSI N14.1 which in turn requires periodic testing of 30B cylinders. This testing includes a hydrostatic test every five years. Before this test, the cylinder is cleaned. Then it is filled with water and pressurized to inspect for possible leaks. This test checks the integrity of the structure including the various welds. This test is expensive, in part because it creates 26 cubic feet of radioactive waste water which must be disposed as low-level radioactive waste.

Further, the NRC regulates how densely conventional 30B cylinders in overpacks may be packed on cargo ships or other conveyances. It does this by allowing each ship or conveyance a total "transportation index" of 200. Each conventional 30B cylinder has a transportation index of five, so a ship carrying no other nuclear cargo can carry a total of forty (40) conventional 30B cylinders. (200÷5=40.) This safety limit denies shippers of conventional 30B cylinders the economy that volume shipments could achieve especially in light of the availability of dedicated charter vessels for radioactive materials. However, this regulation is necessary because even though the hydrostatic test assures structural integrity and the overpack provides thermal and impact protection, there is no sure way to guarantee that the valve will remain watertight using the current 30B design. As noted above, even a small amount of water could conceivably initiate a critical event.

It would be a substantial improvement if a cylinder could be devised that did not require hydrostatic testing and which could guarantee the integrity of its valve. Any improvement to the conventional 30B cylinder must recognize the substantial investment in equipment which is used to handle the existing 30B cylinders, including both the piping and the existing overpacks. This requires that the essential dimensions of the cylinder and the locations of the valve and plug not change.

SUMMARY OF THE INVENTION

According to the present invention, a vessel for the shipment of uranium hexafluoride includes a cylindrical wall closed by pair of approximately semi-ellipsoidal ends welded to form a sealed container. A service valve is located in one end. The valve is covered by a removable, watertight valve protection cover assembly. The vessel also includes a test port by means of which the integrity of the valve protection cover assembly may be tested after the cylinder has been filled with uranium hexafluoride and the valve protection assembly has been installed. The valve protection assembly is shaped so that it fits within the envelope of the standard 30B cylinders, and so fits within the overpacks already approved by the NRC and owned by shippers of uranium hexafluoride.

The vessel made according to the present invention has a double barrier to prevent ingress of water or egress of uranium hex fluoride. The valve, a first barrier, is enclosed by a cover assembly which forms the second barrier. The double barrier has resulted in a transportation index of 0. In effect, then, adding the second barrier allows the improved 30B cylinders to be shipped in bulk with safety acceptable to the NRC, resulting in substantial savings to the industry.

The second barrier is a valve protection cover assembly. One important aspect of using such a valve protection cover assembly is some way to test that it does not allow water into its interior space. The valve cover includes a waterproof domed cavity surrounded by a flange that is bolted against a mating flange on the cylinder. The walls are inherently totally water proof; the only place for water to leak in is between the flanges. To seal the flanges against water, a pair of concentric, resilient seals is provided between the flanges. To assure that the flanges are correctly sealed, a test port is located between the seals. The present invention provides a method and apparatus, which when used in conjunction with an appropriate vessel makes it possible to ship radioactive materials with the assurance that water will not leak between the flanges. This is accomplished using an extremely sensitive vacuum based leak detection system which can test for leakage around the seals. Once the seals have passed the leak test, the test port can be sealed with a suitable plug. This test method and apparatus are described for use with the improved 30B cylinder described herein. However it may also be used with other cylinders for the transport of substantially pure uranium hexafluoride such as 48 inch diameter cylinders.

DESCRIPTION OF PREFERRED EMBODIMENTS

Figure 1:
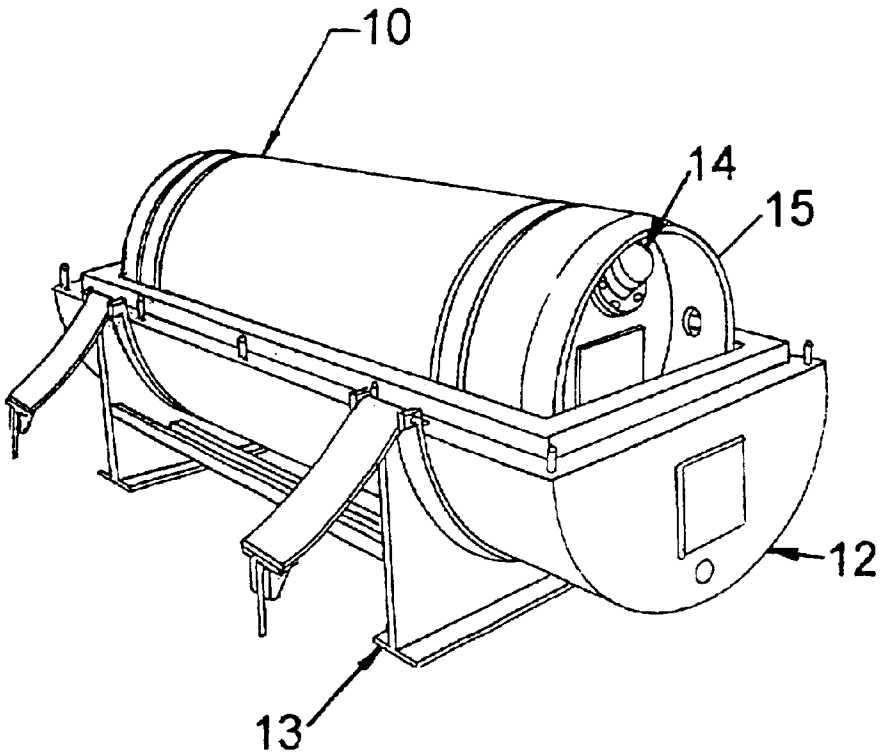
FIG. 1 shows an improved 30B cylinder constructed according to the present invention and held in an open protective shipping package or "overpack" which in turn rests in a cradle.
Figure 1A:
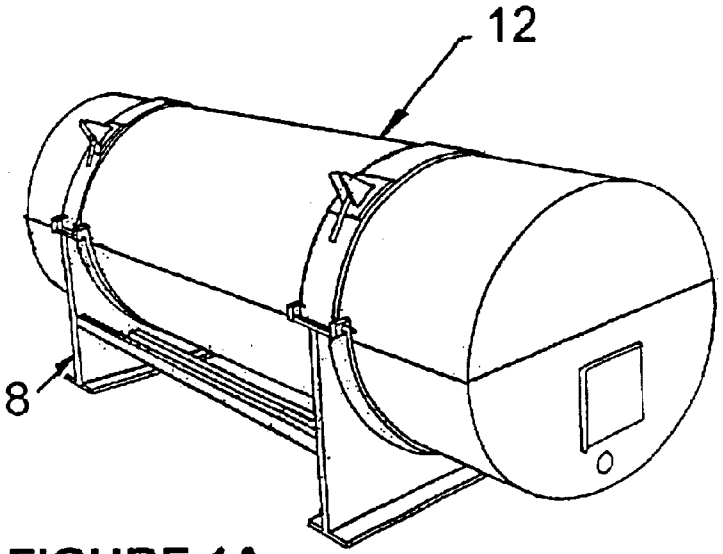
FIG. 1A shows an overpack for a 30B cylinder fully closed and in a cradle.

FIG. 1 shows an improved 30B cylinder 10 constructed in accordance with the present invention. The cylinder 10 is shown inside the bottom half of a protective shipping package or "overpack" 12. The over pack 12 is shown supported in a cradle 13 and with its top half removed and its safety straps open. As is well understood in the art, during shipment to cylinder 10 is filled with up to 5,020 pounds of uranium hexafluoride and fully enclosed in the overpack, as shown in FIG. 1A.

For the most part the improved 30B cylinder 10 of the present invention is entirely conventional and will be described in detail only in so far as it differs from the prior art conventional cylinder. The conventional 30B cylinder 10 is manufactured according to ANSI N14.1 and ASME Boiler and Pressure Vessel Code, Section VIII, Division 1. Accordingly the conventional 30B cylinder is 81½ inches plus or minus ½ inch and has a diameter of 30 inches plus or minus ¼ inch. The conventional 30B cylinder has a volume of at least 26 cubic feet. It is preferred that the cylinder be manufactured according to ANSI N14.1-2000 and therefore include the advantages described in U.S. Pat. No. 5,777,343 which stem from the elimination of a weld backing bar. However, the advantages of the present invention may also be obtained with cylinders manufactured to earlier versions of ANSI N14.1 which required weld backing bars.

Figure 2:
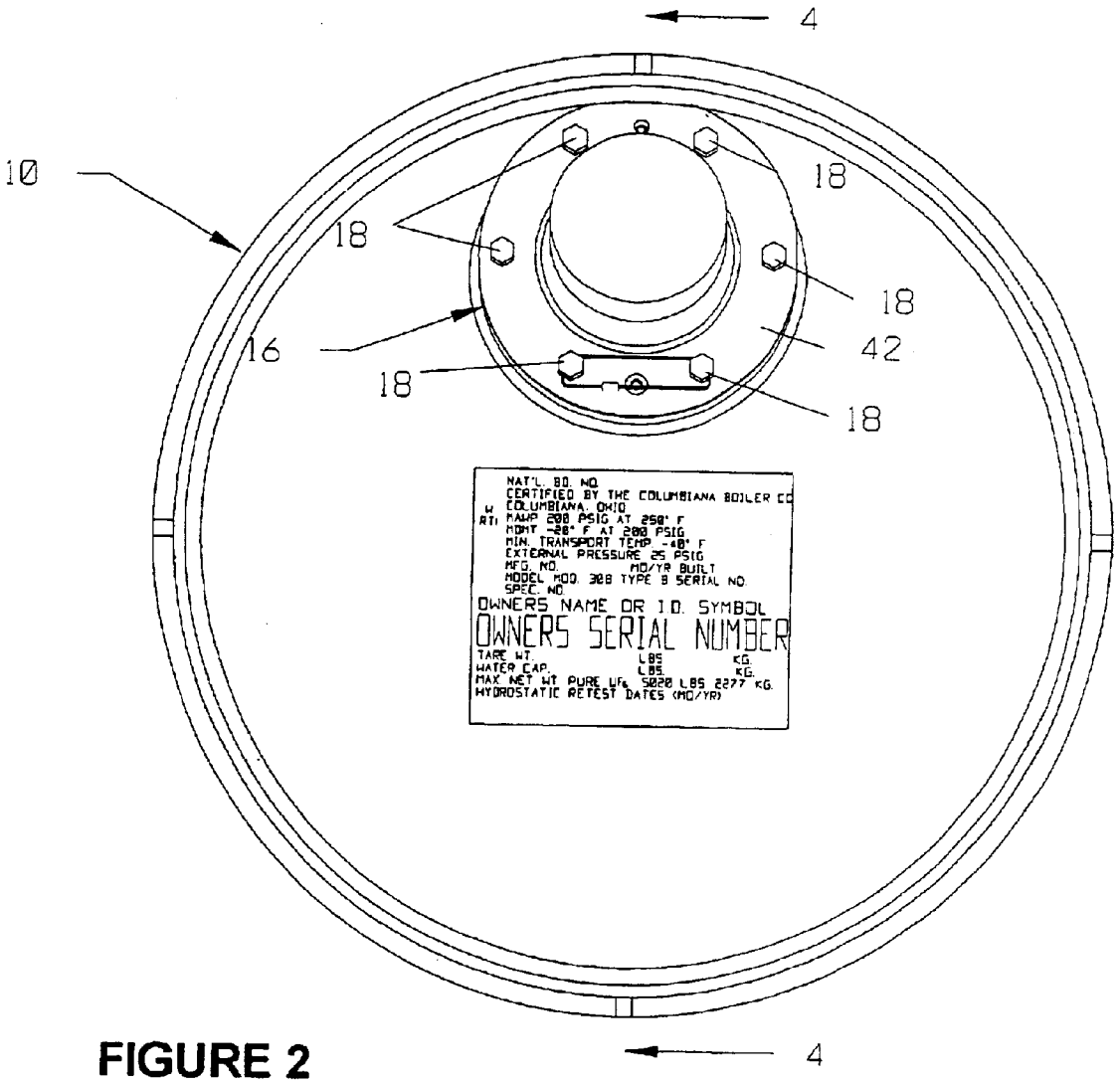
FIG. 2 is an end view of the cylinder of FIG. 1.
Figure 3:
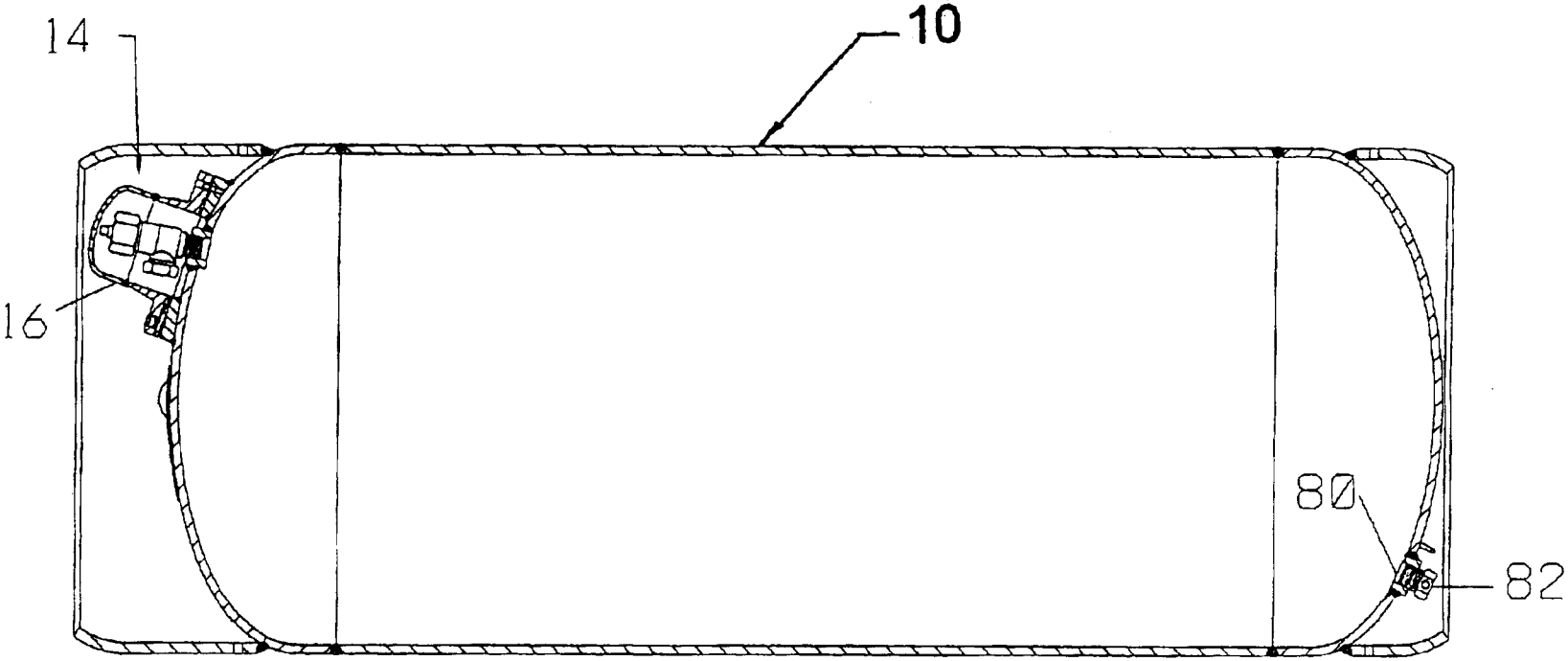
FIG. 3 is a view looking in the direction of arrows 3—3 FIG. 2 and partially in cross section.

The improved 30B cylinder 10 includes a valve which is protected by a valve protection cover assembly 14 (FIGS. 1 and 2). This cover assembly, not found in conventional 30B cylinders, provides a second barrier to the egress of uranium hexafluoride or, more critically, the ingress of water. The valve protection cover assembly 14 fits within the chime 15 which extends from the domed end of the cylinder 10. Therefore the cylinder 10 fitted with the cover assembly 14 may be used with standard overpacks such as the overpack 12 shown in FIGS. 1 and 1A.

The valve protection cover assembly 14 (FIG. 2) includes a cap 16 that is held in place by six bolts 18. Two of the bolts 18 are safety wired, and the wire is sealed to guarantee that the cap 16 has not been tampered with once it is bolted in place. Additional bolts, up to all six, could be safety wired if desired.

Figure 4:
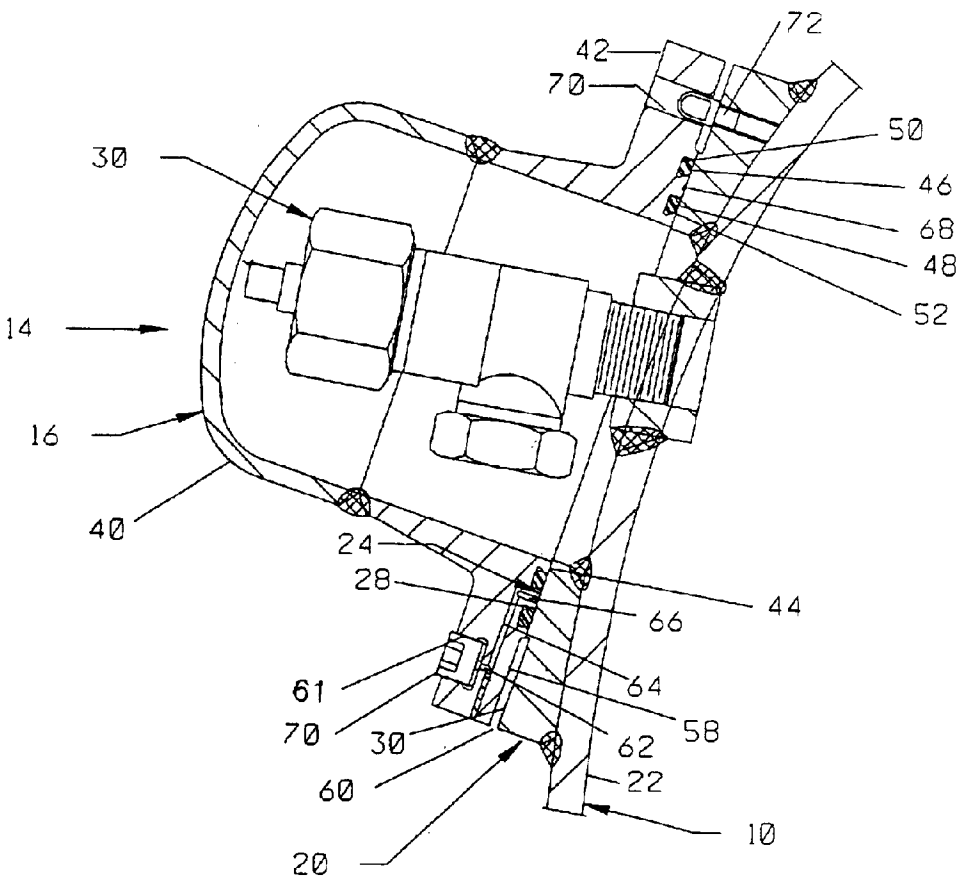
FIG. 4 is an enlarged view of a portion of FIG. 3 showing a valve protection assembly over the valve.

The valve protection cover assembly 14, as shown in greater detail in FIG. 4, includes a cap 16 and a base 20. The base 20 is an annular disk that surrounds the valve 30. The base 20 is a disk that is welded to the wall 22 of the cylinder 10. Its diameter and thickness are selected so as not to interfere with the standard industry plumbing used to connect with the valve 30 to fill or empty the cylinder 10 of uranium hexafluoride.

The base 20 is welded to the wall 22 continuously around its outer and inner perimeters, and these welds are thoroughly inspected to guarantee their integrity. These welds therefore provide a reliable barrier to prevent any matter from passing under the base 20 and so passing from the outside of the cylinder 10 into the volume where the cap assembly surrounds the valve 30 or vice versa. The base 20 also includes six evenly spaced threaded bores (not shown) with which the bolts 18 cooperate to hold the cap 16 in place.

An upper surface 24 of the base 20 includes two regions, an inner region 28 and an outer region 30. The inner region 28 is annular and stands proud of the outer region by about 1/32 inches. The inner region 28 is machined flat and provides a working surface against which the cap 16 seals. The necessary surface flatness may be achieved by machining the base 20 either before or after welding the base 20 to the wall 22.

The cap 16 is a fabricated steel component which includes a dome 40 and a flange 42. While cap 16 could be machined from a single piece of steel, it is preferred for economy and ease of manufacture to fabricate it from two pieces which are welded together as shown. This weld is thoroughly inspected to guarantee its integrity.

The flange 42 mates with the base 20. To this end the flange 42 includes a machined annular surface 44 which seats against the corresponding flat inner surface 28 of the base 20. A pair of O-rings 46 and 48 fit in recesses 50 and 52, respectively, which are formed in the annular surface 44 of the flange 42. The recesses 50 and 52 are circular in plan view, but any endless shape could be used if desired. The recesses 50 and 52 may be formed with a slight undercut as shown in order to retain the O-rings 46 and 48 in place. When the annular surface 44 and the annular surface 28 are seated against each other, the O-rings 46 and 48 are compressed to form an effective seal. This seal is sufficiently complete to achieve a leak rate of less than $10^{-3}$ ref.-cm3/sec, when tested according, for example, to the soap bubble test described in A.5.7 of ANSI N 14.5-1997, Leakage Tests on Packaging for Shipment. Under this test a "reference cubic centimeter cubed per second" is defined as a volume of one cubic centimeter of dry air per second at one atmosphere absolute pressure and 25° C.

While conventional O-rings 46 and 48 are preferred for ease of manufacture, other resilient sealing elements including cast-in-place rubbers or resilient polymers such as urethane are also possible. In addition, any of the seals may be lubricated with a conventional lubricant to provide a better seal. Such alternative materials and manufacturing techniques need only provide a sufficiently leak resistant seal to be satisfactory, and they are included within the meaning of the term "resilient seal elements" used in this application.

The flange 42 includes an annular outer region 58, recessed from the plane of annular surface 44. The outer region 58 is aligned with the outer region 30 of the base 20. The two outer regions 30 and 58 define a gap 60 between them when the cap 16 is in place on the base 20. The flange 42 has six holes (not shown) through the outer region 58 for the bolts 18. These holes align with corresponding threaded passages in the base 20. When the cap 16 is put in place and the bolts 18 tightened to a predetermined torque, the outer region 58 of the flange 42 is stressed, assuring a predetermined, constant load on the O-rings 46 and 48 and the mating annular surfaces 24 and 44. While forming the gap 60 is preferred because it allows the flange 42 to flex slightly, any design that allows a sufficiently tight seal between the base 20 and the cap 16 is acceptable.

The valve protection cover assembly 14 includes a means for testing the integrity of the seal between the cap 16 and the base 20. This test facility includes a test port 61, which leads through internal passages 62, 64, and 66 to test channel 68. The test channel 68 is a semicircular recess (in vertical cross-section) in the annular surface 44 of the flange 42. The recess 68 extends in a complete circle spaced between the recesses 50 and 52.

The flange 42 includes a bore 70 (FIGS. 1 and 4) diametrically opposite the test port 61. This bore cooperates with a pin 72 which projects up from the outer region 28 of the base 20. When the cylinder 10 is in its normal, horizontal position, the pin 72 is at the 12 o'clock position and helps the worker accurately position the cap and place the bolts 18 in their holes.

Once the cap 16 is in place and the bolts 18 tightened appropriately, the integrity of the seal around about may be tested. This is done by connecting the test port to a calibrated source of fluid under pressure or vacuum. The fluid reaches the test channel 68, and if the joint is secure, the fluid can go no farther. If a leak occurs, then the test equipment shows a drop in pressure or vacuum, and the O-ring seals can be inspected and replaced or other repairs made as necessary. Once the testing is complete, a plug 70 is used to seal off the test port. There are a variety of test procedures available, and these are set out in ANSI N14.5-1977. These tests assure leakage rate of less than $1\times10^{-3}$ ref-cm$^3$3/sec.

Although the testing facility is shown as a port, passages, and channel machined in the flange 42 of the cap 16, it is also possible to machine these elements into the base 20. If this is done, the test channel is formed in the surface 28 of the base 20 so that it is located between the places where the O-rings contact the base 20 and is connected to a test port by suitable passages. Similarly, the O-rings 46 and 48 could be mounted in grooves formed in the base. However, the construction shown in the Figures is preferred because it is easier to maintain and because the O-rings 46 and 48 and the test channel 68 are less likely to be damaged when connecting conduits the valve 30.

While the bolts 18 are used to draw the cap 16 tight against the base 20, other fastenings are possible. For example a threaded connection between the base could be used with the necessary O-ring seals and test port channel formed in a screw-on cap. Alternatively, the base 20 could have external threats on its outer peripheral surface and a nut like that used in a plumber's union could be used to pull the cap down against the base.

Figure 5:
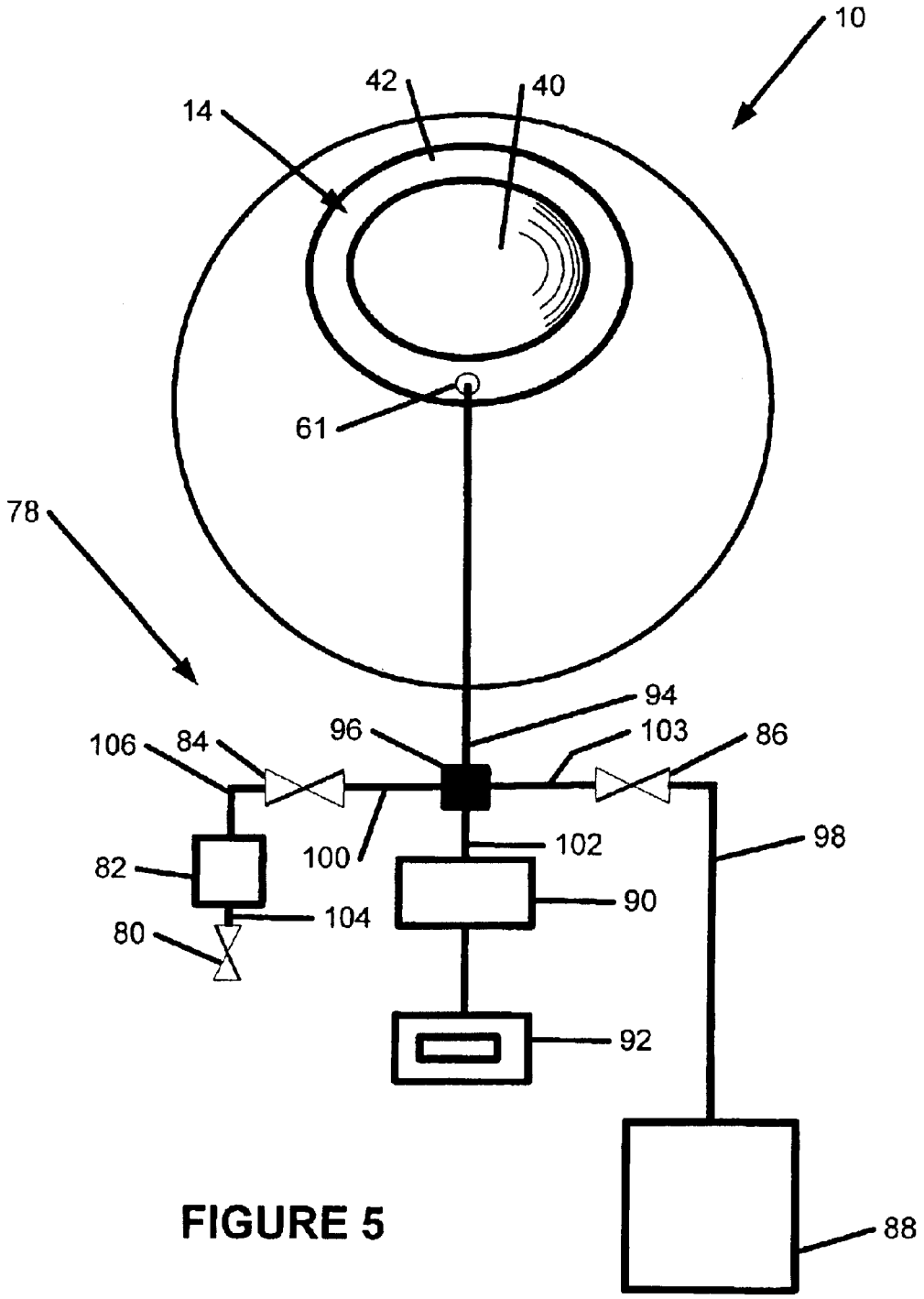
FIG. 5 is a schematic illustration of an apparatus used to test the seal between the valve protection assembly and a flange on the improved 30B cylinder.

FIG. 5 is a schematic diagram of a test apparatus 78 constructed in accordance with the teachings of the present invention. The apparatus is shown connected to the test port 61 in the flange with the valve cover assembly 14 fastened to the machined surface 44 on the cylinder 10. The apparatus 78 can be used to prove a seal up to $1\times10^{-5}$ ref. cm$^3$/sec. The apparatus 78 includes an exhaust valve 80, a reference volume 82, a reference volume valve 84, a vacuum pump valve 86, a vacuum pump 88, and a pressure sensor 90 which includes a pressure display 92, all connected by various conduits and X fitting 96 to the test port 61.

The first step is to determine the volume enclosed by valve 84, valve 86, the conduits 94, 102 and 103 and the volume between the seals 50 and 52. This is termed the Test Volume, $V_{test}$. To this end the reference volume 62 is filled with air at atmospheric pressure by closing the valve 84 and opening valve 80. Thereafter exhaust valve 80 is closed, and the atmospheric pressure, $P_{atmo.}$, is recorded.

Next the vacuum pump valve 86 is opened if it is not already open, and the vacuum pump 88 is then turned on. This draws air and any other gas from the test port 61, through conduit 94, X fitting 96, through conduit 103, vacuum pump valve 86 and conduit 98. It also evacuates the conduit 100 between the X fitting 96 and the reference volume valve 84 and from the conduit 102 that connects the X fitting with the pressure sensor 90 and from the internal regions of the pressure sensor. This vacuum is pulled until it reaches a sufficiently low pressure and maintains that low pressure. This initial process tests the O rings 46 and 48 for gross leakage and also causes them to outgas. The pressure to be maintained depends on the degree of leak resistance to be achieved. In the 30B cylinder shown in the drawings it is considered desirable to sustain a pressure of less than 10 millitorr since this will prove that the leak rate is at most $1\times10^{-5}$ ref. cm$^3$/sec. This may take several hours because of out gassing. Other cylinders such as 48 inch cylinders may require a different level of acceptable leak rate.

Once the pressure has stabilized, for example, at less than 10 millitorr, the vacuum pump valve 86 is closed. If the rate of change of the pressure is more than a desired amount, the test should be stopped and the O rings 46 and 48 should be inspected and the source of the leak eliminated. If the desired low pressure is maintained at a sufficiently steady state, the pressure is noted as $P_{test}$. In the 30B cylinder a leakage rate of less than 1 millitorr per second is applied. This number is derived from the acceptable leak rate. For the 30B cylinder 10 shown in the Figures, the acceptable leak rate has been set at $1\times10^{-5}$ ref. $cm^3$/sec., although it could be set at a different value if one wished to obtain a lesser or greater degree of seal.

Once the pressure in the test volume has stabilized at or below 10 millitorr, the apparatus 78 is ready to determine the volume $V_{test}$. This is done by opening reference volume valve 84. As the reference volume valve 84 is opened, the air in the reference volume 82 expands to fill the test volume, $V_{test}$. This expansion is essentially adiabatic. The expansion of the air in the reference volume causes the pressure in the test volume to increase. The new pressure is recorded as $P_{mix}$.

The initial volume of the reference volume 82 and the conduits 104, 105, and 100 between the valve 80 and the valve 84, $V_{cal}$., is known by measuring it in any convenient manner when the apparatus 78 is manufactured.

The volume $V_{test}$ is given by Boyle's Law:

$$V_{cal.} \times \frac{(P_{atm.} - P_{mix})}{(P_{mix} - P_{test})} = V_{test}$$

The next step is to calculate the minimum time interval, the pass test time, for a pressure change of 1 millitorr. This value depends of the test volume, $V_{test}$, and the maximum acceptable leak rate. For the leak rate of $1\times10^{-5}$ ref. cm3/sec. where $V_{test}$ is measured in cubic centimeters, the following equation is used:

$$\text{Pass test time in seconds} = 0.132 \times V_{test}$$

The conversion factor (0.132) takes into account the various dimensions that must be converted from one set of units to another and the acceptable leak rate.

With these preliminary calculations performed, the actual test for leak rate can be performed. The reference volume valve 84 is closed, and the vacuum pump valve 86 is opened. The vacuum pump is turned on until the pressure drops below 10 millitorr at which time the vacuum pump valve 86 is closed. Once the pressure begins to rise, a timer is started to determine how long it takes for the pressure in $V_{test}$ to rise one millitorr. This time is compared to the test time in seconds determined in the preceding equation. If the actual time is greater than the pass test time, then the outgassing plus any leakage is less than the acceptable rate, and the valve protection cover has at most the acceptable leak rate, in which case the cylinder, for example cylinder 10, is considered to have passed the test. Once the cover has passed the test, the conduit 94 is disconnected from port 61 and the port is closed with a conventional plug (not shown).

Thus it is clear that the present invention provides a vessel 10 for the shipment of uranium hexafluoride that includes a cylindrical wall closed by pair of approximately hemispherical ends 22 welded to form a sealed container. A service valve 30 is located in one end. The valve 30 is covered by a removable, watertight valve protection cover assembly 14. The vessel also includes a test port 61 by means of which the integrity of the valve protection cover assembly may be tested after the cylinder 10 has been filled with uranium hexafluoride or other nuclear material and the valve protection assembly 14 has been installed. The valve protection assembly 14 is shaped so that it fits within the envelope of the standard 30B cylinders, and so fits within the overpacks already approved by the NRC and owned by shippers of uranium hexafluoride.

The vessel 10 made according to the present invention has a double barrier to prevent ingress of water or egress of uranium hexafluoride. The valve 30, a first barrier, is enclosed by a cover assembly 14 which forms the second barrier. In effect, then, adding the second barrier will allow the improved 30B cylinders to be shipped in bulk with safety acceptable to the NRC, resulting in substantial savings to the industry.

Use of the vessel 10 in conjunction with the test apparatus 78 and method disclosed assures that the valve protection cover assembly 14 not only protects the valve 30 from mechanical damage, but also assures that a selected leak rate is not exceeded leak rate. The double barrier in conjunction with the method of testing the seals has resulted in a transportation index of 0 for 30B cylinders constructed and tested according to the present invention.

What is claimed is:

1. A method of shipping substantially pure uranium hexafluoride in a conventional overpack comprising the steps of:

providing a cylinder for the transport of substantially pure uranium hexafluoride comprising a vessel having a cylindrical sidewall and a head closing one end of the vessel, the head being permanently affixed to the sidewall a valve connected to the head of the vessel controlling the flow of matter into and out of the vessel, a sealing surface connected to the vessel and surrounding the valve, a cap over the valve, a pair of seals between the sealing surface and the cap and defining a test volume between the two seals, the cap and the sealing surface, a test port connecting the test volume and an exterior surface of the vessel, fastening means for pressing the cap against the sealing surface to seal a joint between them against the flow of matter from outside the cap to the valve and from the valve to outside the cap, determining a maximum rate of leakage from within the cap to the atmosphere outside the cap by measuring the leakage rate into the test volume with a leak testing apparatus connected to the test port, and thereafter placing the cylinder in a conventional overpack.

2. The method of claim 1 further including the step of placing substantially pure uranium hexafluoride in the vessel prior to performing the determining step.

3. The method of claim 2 wherein the step of determining a maximum rate of leakage from within the cap to the atmosphere outside the cap by measuring the leakage rate into the test volume includes the steps of determining the size of the test volume and calculating an acceptable leak rate for a volume of that size.

4. The method of claim 3 further including the step of measuring the atmospheric pressure, evacuating the test volume to a selected pressure, connecting a container of known volume to the test port and releasing a known volume of gas from the container into the test volume, and measuring the pressure in the combined volume of the container and the test volume.

5. The method of claim 3 wherein the step of determining a maximum rate of leakage from within the cap to the atmosphere outside the cap by measuring the leakage rate into the test volume includes the steps of supplying a test apparatus consisting essentially of a vacuum pump, a pressure gauge, a container of known volume, a valve to control the flow of air from the atmosphere into the container, the vacuum pump, pressure gauge, and container being adapted to be connected to the test port at the same time, a valve controlling the flow of gas from the container into the test volume, and a valve controlling the flow of gas from the test volume to the vacuum pump.

6. A method of shipping substantially pure uranium hexafluoride comprising the steps of:

providing a cylinder for the transport of substantially pure uranium hexafluoride comprising a closed steel vessel having a head end, a foot end, and a cylindrical sidewall permanently affixed to the head end and the foot end to define an interior volume for receiving substantially pure uranium hexafluoride, a valve connected to the head end of the vessel controlling the flow of matter into and out of the vessel, a sealing surface connected to the vessel and surrounding the valve, a cap over the valve, a pair of seals between the sealing surface and the cap and defining a test volume between the two seals, the cap and the sealing surface, a test port connecting the test volume with an an exterior surface of the vessel, fastening means for pressing the cap against the sealing surface to seal a joint between them against the flow of matter from outside the cap to the valve and from the valve to outside the cap, and determining a maximum rate of leakage from within the cap to the atmosphere outside the cap by measuring the combined leakage rate from the atmosphere into the test volume and from the interior volume of the vessel into the test volume.

7. The method of claim 6 further including the step of placing substantially pure uranium hexafluoride in the vessel prior to performing the determining step.

8. The method of claim 7 wherein the step of determining a maximum rate of leakage from within the cap to the atmosphere outside the cap includes the steps of determining the size of the test volume and calculating an acceptable leak rate for a volume of that size.

9. The method of claim 8 further including the step of measuring the atmospheric pressure, evacuating the test volume to a selected pressure, connecting a container of known volume to the test port and releasing a known volume of gas from the container into the test volume, and measuring the pressure in the combined volume of the container and the test volume.

10. The method of claim 8 wherein the step of determining a maximum rate of leakage from within the cap to the atmosphere outside the cap includes the steps of supplying a test apparatus comprising a vacuum pump, a pressure gauge, a container of known volume, a valve to control the flow of air from the atmosphere into the container, the vacuum pump, pressure gauge and container being adapted to be connected to the test port at the same time, a valve controlling the flow of gas from the container into the test volume, and a valve controlling the flow of gas from the test volume to the vacuum pump.

11. An apparatus for shipping substantially pure uranium hexafluoride comprising a cylinder for the transport of substantially pure uranium hexafluoride comprising a vessel having a cylindrical sidewall and a head closing one end of the vessel, the head being permanently affixed to the sidewall, a valve connected to the head of the vessel controlling the flow of matter into and out of the vessel, a sealing surface connected to the vessel and surrounding the valve, a cap over the valve, a pair of seals between the sealing surface and the cap, the seals defining a test volume between the two seals, the cap, and the sealing surface, a test port connecting the test volume with an exterior surface one of the vessel and the cap, fasten means for pressing the cap against the sealing surface to seal the joint between them against the flow of matter from outside the cap to the valve and from the valve to outside the cap, and a leak detection device adapted to be connected to the test port.

12. The apparatus of claim 11 wherein the leak detection device includes a vacuum pump, a pressure gauge, a container of known volume, a valve to control the flow of air from the atmosphere into the container, the vacuum pump, pressure gauge, and container being adapted to be connected to the test port at the same time via a manifold, a valve controlling the flow of gas from the container into the test volume, and a valve controlling the flow of gas from the test volume to the vacuum pump.

13. The apparatus of claim 12 wherein the volume of the container of known volume is comparable to test volume.

* * * * *